United States Patent [19]

Rose

[11] 4,306,213

[45] Dec. 15, 1981

[54] LAYERED PLASTIC FUSE

[75] Inventor: John A. Rose, Mentor, Ohio

[73] Assignee: General Electric Company, Schenectady, N.Y.

[21] Appl. No.: 115,927

[22] Filed: Jan. 28, 1980

[51] Int. Cl.[3] ..... H01H 85/04

[52] U.S. Cl. ..... 337/297; 337/415

[58] Field of Search ..... 337/197, 198, 401, 296, 337/297, 415, 416; 240/1.3

[56] References Cited

U.S. PATENT DOCUMENTS

| | | | |
|---|---|---|---|
| 3,500,276 | 3/1970 | Hingorany et al. | 337/416 |
| 4,017,728 | 4/1977 | Audesse et al. | 240/1.3 |
| 4,208,645 | 6/1980 | Harmon et al. | 337/297 |

FOREIGN PATENT DOCUMENTS

| | | | |
|---|---|---|---|
| 2109790 | 9/1971 | Fed. Rep. of Germany | 337/297 |

*Primary Examiner*—George Harris
*Attorney, Agent, or Firm*—Lawrence R. Kempton; Philip L. Schlamp

[57] ABSTRACT

This invention relates to fuses for electrical plugs and more particularly to a high and low overcurrent stratified fuse for use in a low power electrical circuit. The fuse has a layered construction in which a particulate conductive link is cooperatively applied and adhered to a heat deformable substrate. The substrate in a further preferred embodiment is thermally isolated by an insulating layer abutting the substrate on the side opposite the conductive link. The conductive link melts or disintegrates in response to high over current conditions. The substrate deforms and breaks the conductive link applied thereto in response to low over current conditions.

11 Claims, 3 Drawing Figures

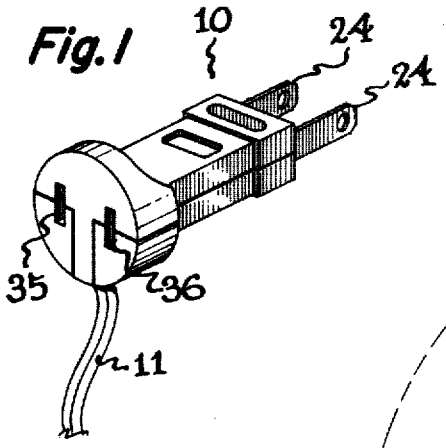
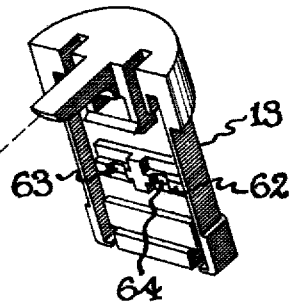
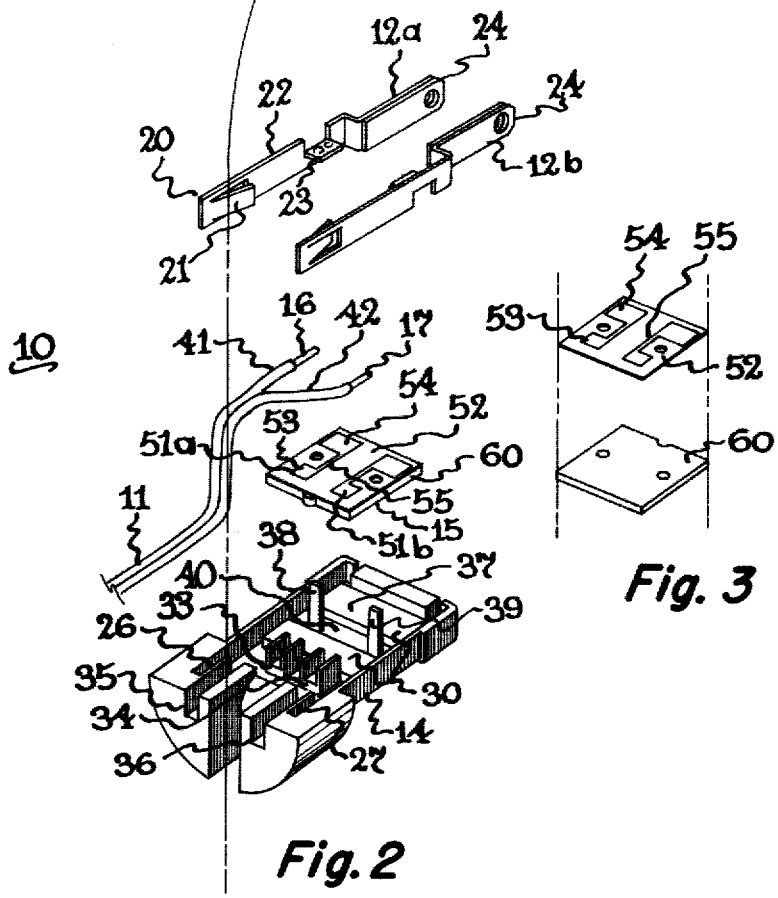
Fig. 3
Fig. 2

LAYERED PLASTIC FUSE

This invention relates to fuses for electrical plugs and more particularly to a high and low overcurrent stratified fuse for use in a low power electrical circuit. The fuse has a layered construction in which a particulate conductive link is cooperatively applied and adhered to a heat deformable substrate. The substrate in a further preferred embodiment is thermally isolated by an insulating layer abutting the substrate on the side opposite the conductive link. The conductive link melts or disintegrates in response to high over current conditions. The substrate deforms and breaks the conductive link applied thereto in response to low over current conditions.

BACKGROUND OF THE INVENTION

It is desirable to include overload protection devices such as fuses in combination with electrical devices which upon failure do not draw sufficient current to melt or blow an external fuse. Two fuse elements, one for each terminal of a plug are often required inasmuch as most plugs are reversible and it is impractical to determine which terminal is the primary current carrier and should therefore be fused.

Conventional overload protection fuses are expensive and contribute substantially to the cost of product manufacture.

Various attempts have been made to produce inexpensive yet reliable fuses. The most common of these is the auto glass replaceable fuse in which a fuse wire is enclosed in and extends through a glass tube. The protruding ends of the wire are electrically secured to a pair of conductive end caps for subsequent external connection. Such constructions are expensive and bulky and afford only high over current protection.

A layered fuse construction has been employed as an inexpensive alternative to the glass envelope construction. In a typical construction, a conductive strip is superimposed on a substrate and a metal backing layer. These constructions are inexpensive and permit direct access to the fuse conductor, but do not provide low over current protection for lower power devices. The fuse substrate does not contribute to the protective action of the fuse but serves only as base on which to support the conductive strip. The protective action of these fuses is solely attributable to melting of the conductive strip in response to excessive current therethrough. Teflon coated Kapton and Mylar (tradenames of E. I. du Pont de Nemours & Co.) have been suggested as suitable substrates for the metal strips. These fuses are employed in heavy duty appications and require a rigid metal backing layer to abstract heat from the substrate and prevent heat from building up and causing the conductive strip to prematurely melt.

Other fuses provide both high and low over current protection and employ a conductive strip which is secured to an expandable substrate. In a particular example, a conductive strip is secured to a ceramic substrate. The substrate is a functional part of the fuse and contributes to the fuse protection by expanding and cracking in response to continuous or durational low over current conditions. Fracture of the substrate also breaks and separates the conductive strip secured thereto. Additionally during high overcurrent conditions the conductive strip melts in response to the normal joule or $I^2R$ heating created by current passing through the conductive strip. Ceramic fuses are unattractive because the substrate layer must be thin and substantially porous in order for it to expansively crack under low over current conditions and consequently the fuse is expensive and fragile. The ceramic fuse is particularly inappropriate for rough service applications such as in an electrical plug.

Oriented plastic sheet material have been used in a fuse as substrate materials as disclosed in copending application Ser. No. 858,940, (now U.S. Pat. No. 4,208,645) assigned to the assignee of the present invention and incorporated herein by reference. While oriented plastic substrate fuses do provide both high and low over current protection, oriented plastic sheets are expensive and difficult to work. Also while it is preferrable that the orientation of the sheet be disposed in relation to the conductive strip. The orientation of the sheet is not readily determinable. Additionally the degree or extent of orientation must be taken in to account as a variable in fuse calibration.

SUMMARY OF THE INVENTION

It is therefore an object of this invention to provide an inexpensive polymer substrate high and low overcurrent fuse having a layered construction for use in combination with and as an internal component of an electrical plug. A fuse having multiple fusing elements is easily manufactured. The plug can for instance be connected to and used in combination with any of a number of low current devices such as the low power decorative string light set disclosed in copending applications Ser. No. 859,055 (now U.S. Pat No. 4,241,387) and 35,932 (now U.S. Pat. No. 4,253,233), assigned to the assignee of the present invention and incorporated herein by reference.

More particularly the present invention provides an inexpensive high and low overcurrent layered fuse in which a conductive strip or link is applied and cooperatively adhered to a plastic substrated formed from a thermoplastic material which is not an oriented plastic. The plastic substrate materials in a preferred embodiment are selected from the class which includes polystyrenes and polyesthers. The conductive layer may comprise a thin metalic strip which is bonded to the plastic substrate however in a preferred embodiment a conductive ink or paste having metal particles therein, such as DuPont #4049 silver paste is printed on the substrate. The conductive ink is readily adherent to plastic substrates and is generally comprised of metal flakes disposed in a polyesther carrier which, upon drying, link in a substantially linear configuration to form a highly conductive pattern such as a strip or link.

The conductive strip melts in response to high over current conditions. The plastic substrate deforms or melts in response to low over current conditions. The link which is applied and cooperatively adhered to the plastic substrate is also broken or fractured by the melting or deformation of the substrate.

Non oriented plastic substrates are particularly attractive inasmuch as they are inexpensive, readily available and need not be disposed in a particular orientation with respect to the conductive strip. Further non oriented plastics do not introduce the extent or degree of orientation as additional variables in fuse calibrations.

In a still further preferred embodiment the non oriented plastic substrate is employed in combination with a thermally insulating backing layer which is disposed in abutting contact with the side of the plastic substrate opposite that on which the conductive strip is adhered.

In a preferred embodiment the backing layer is a polyurethane foam material which may have a density of approximately 20 lbs./cu. ft.. The foam is generally flexible and adds bulk to the plastic substrate. Foam is preferred as a backing layer inasmuch as it is inexpensive, light weight and readily handled. The thermally insulating backing layer in alternate embodiments may be poured onto and thus integrally bonded with the substrate or attached thereto by suitable adhesive or placed in contigious and abutting contact with the substrate to retain the heat produced by the conductive link within the substrate to effect faster action low overcurrent fusing through heat activated deformation of the substrate.

The fuse in a preferred embodiment is generally planar and has a pair of conductive strips applied to the surface thereof and particularly configured for making contact with the line and through terminal conductors of a plug. The fuse in an alternate preferred embodiment is enclosed within a polymer snap fit or untrasonically bonded plug housing which, in a preferred embodiment, exerts a compressive force between the line terminal contacts and the fuse to compressively hold the line terminals in electrical contact with the conductive fuse strips. A resiliently compressible backing layer such as polyurethane foam resiliently absorbs the compression forces and enables the terminals to remain in positive electrical contact for more than a few years.

Further objects and features and a more complete understanding of the present invention will be apparent from the following description which taken in conjunction with the drawings represents the preferred embodiments of the present invention.

BRIEF DESCRIPTION OF THE DRAWINGS

FIG. 1 is a perspective illustration of an assembled plug housing in accordance with the present invention.

FIG. 2 is an exploded perspective view of the plug housing in accordance with the present invention.

FIG. 3 is an exploded perspective illustration of the fuse in accordance with the present invention.

DETAILED DESCRIPTION OF THE DRAWINGS

Referring now to FIG. 1, a plug generally designated as 10 is shown in an assembled embodiment. The plug 10 is formed from molded mating plastic halves which are snap fit or ultrasonically bonded together to form an impact resistant enclosure which protects the internally disposed terminals, line and fuse connections. The plug 10 is provided with a line cord 11 which protrudes from the plug 10 and, in a preferred embodiment, is connected to a low power accessory such as a decorative string set. In particular, the fused plug of the present invention provides an overcurrent protection device between the wall outlet and an accessory and thus enables the use of lighter gage wire after the fuse is plugged into a low power accessory. In the decorative string set preferred embodiment of this invention, line cord 11 may be for instance 24 AWG wire.

Referring now to FIG. 2 the plug 10 of the present invention is shown in exploded form. The plug 10 generally comprises mating upper and lower halves 13 and 14 respectively which are snap fit or ultrasonically joined or bonded together to enclose a fuse 15 and portions of the through terminal connections 12*a* and 12*b* as well as the the ends 16 and 17 of the line cord 11.

Each through terminal 12 has a substantially planar configuration and includes a rear portion 20 having a contact flange 21 inwardly and angularly articulated therefrom for engaging in electrical contact a terminal blade of a stacked plug (not shown). The through terminal 12 also has an intermediate portion 22 having a inwardly projecting fuse contact blade 23 and a end terminal blade 24 which protrudes from the plug 10.

The plug halves 13 and 14 in combination define a pair of channels 26 and 27 each of which individually receives and secures the rear and intermediate portions of the terminal 12 therein with the blade 24 projecting exteriorily from the plug 10.

The lower plug half 14 is additionally provided with a fuse mounting surface 30, line cord receptacles 33 and 34 and a rear access openings 35 and 36 for receiving stacked terminals therethrough.

The fuse mounting 30 has a generally planar upper surface 37 on which the substantially planar fuse 15 is located. The fuse mounting in one embodiment is provided with a central cavity 40 beneath the overlying fuse elements for preventing the material of the fuse mounting 30 from conducting heat to or from the fuse substrate and thus interferring with the thermally activated fuse operation. The cavity 40 in a preferred embodiment is provided only in the area beneath the fuse elements 55 with the fuse contact surfaces being disposed on rigid mounting surfaces.

The fuse 15 in one embodiment is secured to the mounting 30 by suitable retaining means such as pins 38 and 39 which protrude form the fuse mount 30 and pierce and hold the fuse in fixed relation with the plug without securing the fuse substrate in planar relation to the fuse mounting 30. In an alternate embodiment the interior walls of the plug 10 may be slotted for receiving the exterior edges of the fuse 15 in snap fit connection therein.

The line cord receptacles means 33 and 34 are for instance two inwardly projecting channels having substantially U-shaped cross sections, the interior diameter of which is slightly less than the outside diameter of the line wires 41 and 42. The receptacle means 33 and 34 secure the line cords 41 and 42 in fixed relation within the plug 10 with the ends 16 and 17 of the line cords 41 and 42 being held in electrical contact with fuse conductors 51*a* and 51*b* respectively. The line cord ends 16 and 17 in one embodiment are provided with exterior electrical terminals having prongs for effecting penetrating electrical connection with the conductive wire enclosed within the insulated cord 11. In an alternate embodiment the ends 16 and 17 of the wires 41 and 42 are striped of insulation to expose the inner conductive wires which make direct electrical contact with the conductive strips 51*a* and 51*b* of the fuse 15. In either embodiment the ends 16 and 17 of the wires 41 and 42 are electrically connected to the fuse strips 51*a* and 51*b* by for instance solder or in an alternate embodiment are held in pressure contact therewith as will be explained below.

Although any particular two wire circuit has only one hot current carrying lead-in conductor and thus should require only one fuse element, practical realities do not afford the luxury of determining, by for instance prespecified convention, which conductor is in fact the hot current carrier. Accordingly it is preferred that the fused plug of the present invention provides a fuse element for each conductor to obviate the possibility of a calamity which might otherwise result from the incorrect selection of the hot conductor. Further inasmuch as the fuse construction of the present invention is inexpensive and readily adaptable to mass production techniques, the added cost of this dual fusing is insignificant.

The fuse 15 of the present invention provides high and low overcurrent protection for a circuit connected thereto. The fuse 15 has a layered construction in which a conductive strip or link 51 is applied and coopertively adhered to a substrate 52. The conductive strip or link 51 has two ends or terminal portions 53 and 54 which are interconnected by a calibrated fuse element portion 55. The physical dimension (length width and thickness) of the fuse element in combination with the resistivity of the material determine the resistance of the fuse element and more particularly the joule heating ($I^2R$ heating) producable thereby in response to a current therethrough. These parameters also determine the blow points or the current points at which the substrate 52 and the fuse conductor 51 will melt or instantaneously disintegrate. Accordingly the precise dimensions of the fuse element 51 must be chosen to effect the desired nominal fusing point for the circuit.

The conductive link is applied and cooperatively secured to a polymer substrate which in response to continuous low overcurrent heating by the conductive link, deforms (shrinks or melts) and breaks or separates the cooperatively secured conductive link to effect low overcurrent fusing. Accordingly the proper selection of the substrate material 52 is important. It has been found that thermoplastic materials work well as fuse substrates. In a preferred embodiment the substrate material is selected from the class including polyesthers and polystyrenes. These substrate are flexible and generally have a thickness of 0.001–0.010 inches.

In a preferred embodiment the conductive link 51 is a screen print of Dupont 4049 conductive paste having silver flakes suspended in a polyesther carrier. This paste after drying exhibits a resistivity in the range of 0.05–0.1 ohms/square/mil. Accordingly a fuse 15 having a nominal rating in the range of 0.35–9.00 amperes is produced by applying a conductive element 55 having the general dimensions as follows: thickness 0.0075–0.002 inches: width 0.020–0.280 inches and length approximately 0.20 inches. More particularly, a fuse having an 0.8 ampere rating is made by providing a fuse element 55 having the approximate thickness of 0.001 inch and an approximate width of 0.025 inches and a length of 0.20 inches is cooperatively applied to the plastic substrate 52 having a thickness in the range of 0.001–0.010 inches.

While it has been found that a layered high and low overcurrent fuse is readily achievable by providing a conductive link which is cooperatively adhered to a non oriented plastic substrate, the operation of this fuse in particular and other layered fuses in general is improved by providing these fuses with a thermally insulating backing layer. As stated above the desired operation of the fuse is critically dependent upon the joule heating produced by the conductive link. If this heating is interferred with by for instance the disipation of the generated heat to a substrate through a heat sink or other thermally conductive material or if the ambient heat of the plug is allowed to influence the fuse, the fusing point will be altered and the fuse may produce a inaccurate result.

Accordingly in a further preferred embodiment, the non oriented plastic substrate high and low overcurrent fuse of the present invention is provided with an insulating backing layer 60 which is shown in more detail in FIG. 3. In alternate embodiments the backing layer 60 is separated from, adhered to or poured onto and thus integrated with the plastic substrate 52 on the side opposite the conductive link 51. While a wide variety of thermally insulative backing layers are available and work well, a preferred embodiment of the present invention employs polyurethane foam backing layer 60 having a substantially planar configuration and a thickness in the range of approximately 0.01–0.1 inches.

The backing layer 60 in addition to providing thermal insulation also provides a resiliently compressible backing against which the fuse substrate 56 may be pressed. In a preferred embodiment the line cord contacts 16 and 17 are pressed into and maintained in contact with the conductive strips **51*a* and 51*b* by pressure plate 62 located on and projecting from the interior of the upper half of plug 13. The pressure plate 62 is more particularly located vertically above the line cord contacts 16 and 17 and not above either the cord receptacles 33 and 34 or the fuse locating pins 38 and 39. The pressure plate 62 may be provided with grooves 63 and 64 for positively registering the line cord contacts 16 and 17. The pressure plate 62 projects inwardly from the upper half 14 a sufficient distance to press contacts 16 and 17 into positive electrical contact with the fuse element terminal 53 as the upper half of the plug 13 is joined to the lower half 14. The foam backing layer 60, also compressed by the joining of the plug halves 13 and 14, maintains the contacts 16 and 17 in good mechanical and electrical connection with the fuse terminals 53 over a period of years inasmuch as polyurethane foam takes only about a 10% compression set over a term of years. Accordingly the foam layer 60 is generally compressed between 15–67%. Additionally the resilient compression of the foam backing layer 60** is useful to compensate for normal tolerance variations produced during fabrication and assembly of the parts.

It will be appreciated that the present invention provides a practical and inexpensive fuse for electrical devices and more particularly for low power devices. Although the fuse has been described in combination with a plug housing it is readily apparent that the fuse of the present invention may be used in combination with a variety of other electrical devices.

Although the invention has been described in its preferred form with a certain degree of particularity, it is understood that the present disclosure of the preferred embodiment is made by way of example and that modifications in the details of construction may be resorted to without departing from the true spirit and scope of this invention. It is intended that the patent shall cover, by suitable expression in the appended claims, whatever features of patentable novelty exist in the invention disclosed.

What is claimed is:

1. A layered fuse comprising a conductive link applied and cooperatively adhered to a non-oriented plastic substrate, wherein said substrate deforms and fractures said conductive link in response to lower over current conditions and said conductive link disintegrates in response to high over currents.

2. The layered fuse of claim 1 wherein said substrate is a thermoplastic material.

3. The layered fuse of claim 1 wherein said substrate is selected from the class containing polyester and polystyrene.

4. The layered fuse of claim 1 wherein said substrate is 0.001 to 0.01 inches thick.

5. The layered fuse of claim 1 wherein said conductive link is approximately 0.0075–0.002 inches thick; is 0.020–0.280 inches wide and 0.200 inches long.

6. The layered fuse of claim 1 wherein said fuse is enclosed with a plug on a mounting plate, said mounting plate having a cavity beneath the fuse elements.

7. The layered fuse of claim 1 wherein said fuse further includes a thermally insulating backing layer on the side opposite the conductive link.

8. The layered fuse of claim 7 wherein said backing layer is secured to said substrate.

9. The layered fuse of claim 7 wherein said backing layer comprises a polyurethane foam material.

10. The layered fuse of claim 9 wherein said backing has a density of approximately 20 lbs/cu.ft.

11. The layered fuse of claim 7 wherein said backing layer supports said substrate in resilient compression within a plug housing, and said conductive link is in pressure contact with a pair of terminals.

* * * * *